US006848922B2

(12) United States Patent
Coughlan et al.

(10) Patent No.: US 6,848,922 B2
(45) Date of Patent: Feb. 1, 2005

(54) SOCKET CONTACT WITH INTEGRALLY FORMED ARC ARRESTING PORTION

(75) Inventors: Christopher Coughlan, Hudson, MA (US); Vadim Radunsky, Framingham, MA (US)

(73) Assignee: Hypertronics Corporation, Hudson, MA (US)

( * ) Notice: Subject to any disclaimer, the term of this patent is extended or adjusted under 35 U.S.C. 154(b) by 0 days.

(21) Appl. No.: 10/795,547

(22) Filed: Mar. 8, 2004

(65) Prior Publication Data

US 2004/0180563 A1 Sep. 16, 2004

Related U.S. Application Data

(60) Provisional application No. 60/453,258, filed on Mar. 10, 2003.

(51) Int. Cl.[7] ..... H01R 13/53
(52) U.S. Cl. ..... 439/181
(58) Field of Search ..... 439/181, 843, 439/387, 856, 842, 851–857, 862, 839

(56) References Cited

U.S. PATENT DOCUMENTS

| | | | | |
|---|---|---|---|---|
| 1,833,145 | A | * 11/1931 | Wilhelm | 439/835 |
| 2,900,631 | A | * 8/1959 | Love | 348/825 |
| 3,023,789 | A | * 3/1962 | Bonhomme | 140/93 R |
| 3,107,966 | A | * 10/1963 | Bonhomme | 439/843 |
| 3,229,356 | A | * 1/1966 | Bonhomme | 29/861 |
| 3,470,527 | A | * 9/1969 | Bonhomme | 439/843 |
| 3,557,428 | A | * 1/1971 | Bonhomme | 29/747 |
| 3,858,962 | A | * 1/1975 | Bonhomme | 439/843 |
| 4,260,214 | A | 4/1981 | Dorn | |
| 4,464,583 | A | 8/1984 | Holmgren | |
| 4,600,260 | A | 7/1986 | Stepniak et al. | |
| 4,713,018 | A | 12/1987 | Sutton | |
| 4,749,357 | A | 6/1988 | Foley | |
| 4,773,872 | A | 9/1988 | Borgstrom et al. | |
| 4,863,392 | A | 9/1989 | Borgstrom et al. | |
| 5,295,863 | A | 3/1994 | Cady | |
| 5,445,533 | A | 8/1995 | Roscizewski et al. | |
| 5,482,480 | A | * 1/1996 | Miyazaki | 439/774 |
| 5,486,123 | A | * 1/1996 | Miyazaki | 439/825 |
| 5,588,852 | A | 12/1996 | Puerner | |
| 5,591,039 | A | 1/1997 | Matthews | |
| 5,606,150 | A | 2/1997 | Radliff et al. | |
| 5,636,306 | A | 6/1997 | Mock et al. | |
| 5,676,571 | A | 10/1997 | Matthews | |
| 5,850,056 | A | 12/1998 | Harwath | |
| 5,928,007 | A | 7/1999 | Lundback | |
| 6,011,218 | A | 1/2000 | Burek et al. | |
| 6,042,432 | A | 3/2000 | Hashizawa et al. | |
| 6,068,498 | A | 5/2000 | Strack | |
| 6,102,746 | A | 8/2000 | Nania et al. | |
| 6,124,550 | A | 9/2000 | Funken et al. | |
| 6,201,184 | B1 | 3/2001 | Francois et al. | |
| 6,227,251 | B1 | 5/2001 | Ahn et al. | |
| 6,254,439 | B1 | 7/2001 | Endo et al. | |
| 6,264,508 | B1 | 7/2001 | Lehmann | |
| 6,297,447 | B1 | 10/2001 | Burnett et al. | |
| 6,413,103 | B1 | 7/2002 | Merz et al. | |
| 6,422,900 | B1 | 7/2002 | Hogan | |
| 6,425,786 | B1 | 7/2002 | Scholler | |
| 6,520,998 | B1 | * 2/2003 | Scholler et al. | 439/851 |
| 6,548,762 | B2 | 4/2003 | Jiles et al. | |
| 6,645,007 | B1 | 11/2003 | Ko | |
| 6,752,668 | B2 | * 6/2004 | Koch, Jr. | 439/843 |
| 6,767,260 | B2 | * 7/2004 | Beloritsky et al. | 439/843 |
| 2002/0055290 | A1 | 5/2002 | Jazowski et al. | |
| 2003/0008542 | A1 | 1/2003 | Shoepf et al. | |

* cited by examiner

*Primary Examiner*—Ross Gushi
*Assistant Examiner*—Phuongchi Nguyen
(74) *Attorney, Agent, or Firm*—Randall J. Knuth

(57) ABSTRACT

A socket contact for meeting with a pin contact in an electrical conductor is shown. The socket contact is provided with an electrical contact-attaching section formed within a receptacle section for providing a electrically efficient design. A pin having at one section diameter larger than the interior diameter of the receptacle section initially engages the arc arresting portion and establishes an electrical connection between the pin and the socket contacts. The socket contact retains the pin in a centrally disposed opening after insertion, eliminating contact between the pin and arc arresting area.

9 Claims, 4 Drawing Sheets

SOCKET CONTACT WITH INTEGRALLY FORMED ARC ARRESTING PORTION

CONTINUATION DATA

This application hereby claims the benefit under Title 35, United States Codes § 119(e) of any U.S. application Ser. No. 60/453,258 filed Mar. 10, 2003, and is hereby incorporated by reference.

BACKGROUND OF THE INVENTION

1. Field of the Invention

The present invention relates to socket contacts for use in electrical connectors and more particularly to socket contacts with a structure for protecting against arcing between the related pin contact and the inner portion of the socket contact. Most particularly, it relates to such a contact/pin arrangement in which the inner portion is protected against arcing while superior vibration control features are utilized.

2. Description of the Related Art

Socket contacts that are generally too tubular in shape have been provided in use in electrical connectors. In use the socket contact is connected to a voltage source and has an end with an opening designed for receiving the protruding end of relating pin contact.

When an electrical potential exists between a socket and pin contacts, arcing may occur between the contacts where they are brought close together for mating. Any arcing will cease once the socket and pin contacts make physical contact, at which time current passes between the contacts causing the electrical potential difference to dissipate. Arcing may melt or erode the particular parts of the assembly thereby causing damage thereto and reducing the performance of the socket contact. Other socket prior art contact/pin assemblies suffer from potential fretting corrosion in vibrating environments. Furthermore, prior arc arresting features imparted a relatively high normal force to the surface of the mating contacts such as shown in U.S. Pat. No. 5,676,571 to ensure contact is made and to prevent additional arcing during insertion. This high applied normal force is not advantageous in light of vibration conditions especially considering the geometry of particular spark-arresting features against mating contacts.

SUMMARY OF THE INVENTION

The present invention, in one form thereof, provides a socket contact for use with a pin contact in an electrical connector. The socket contact of the present invention provides protection against electrical arcing damage while providing a unique vibration suppression structure to prevent possible fretting corrosion in particular environments.

The present invention, in another form thereof, creates socket contacts including an electrical component attaching insertion strictly formed with a tubular receptacle section. The receptacle section is provided with a central longitudinal axis, a bore extending along the axis formed from an interior surface which is generally circular in cross-section and an arc arresting end portion about the bore. The opening of the arc arresting bore portion has a diameter smaller than the larger portion of the pin. The pin includes a collapsible structure located at the distal end for insertion and contact into the arc arresting end portion and into the bore. The geometry of the structure is such that after full insertion of the pin into the receptacle section, the pin is not in contact with the arc arresting end portion of the receptacle.

The present invention, in yet another form thereof, the pin includes a collapsing structure, most preferably a slot with a pin with an enlarged end. The slot is structured to allow passage of the pin past the arc suppressing member of the receptacle and on into capture with the electrical contact within the receptacle.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

In accordance with the present invention, a female electrical conductor provides for contacting a male counterpart. The female electrical connector includes an outer structure and an inner structure. The outer structure has a longitudinal axis and a first inner surface for receiving a first contact member of the male counterpart. The outer structure further includes a first conductive contact structure monitored within the outer structure for contacting the male counterpart (pin) upon the insertion of the first contact member into the structure.

Figure 1:
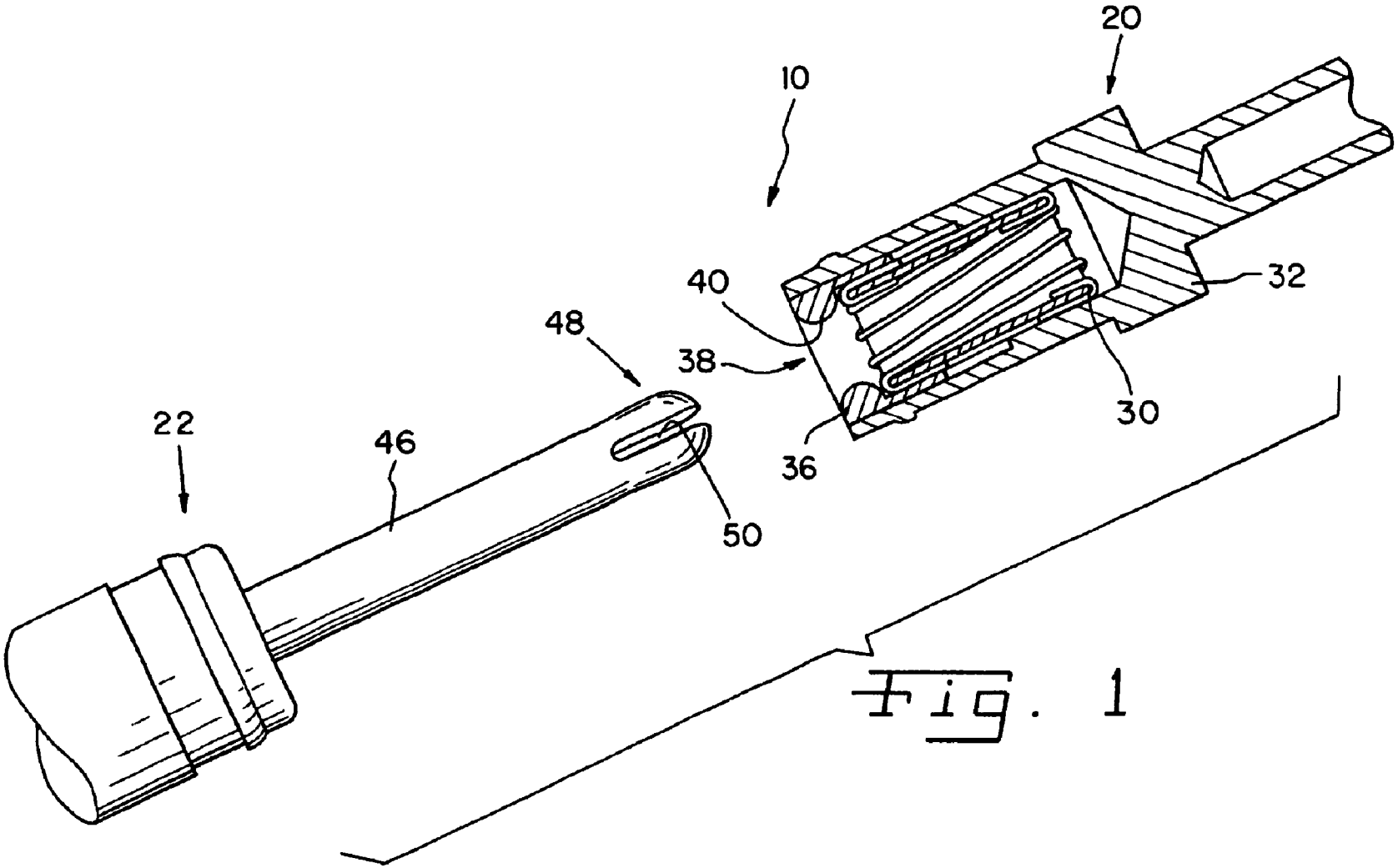
FIG. 1 is a view of the pin contact being partially inserted into a partial sectional view of the socket contact in accordance of one embodiment of the present invention.
Figure 2:
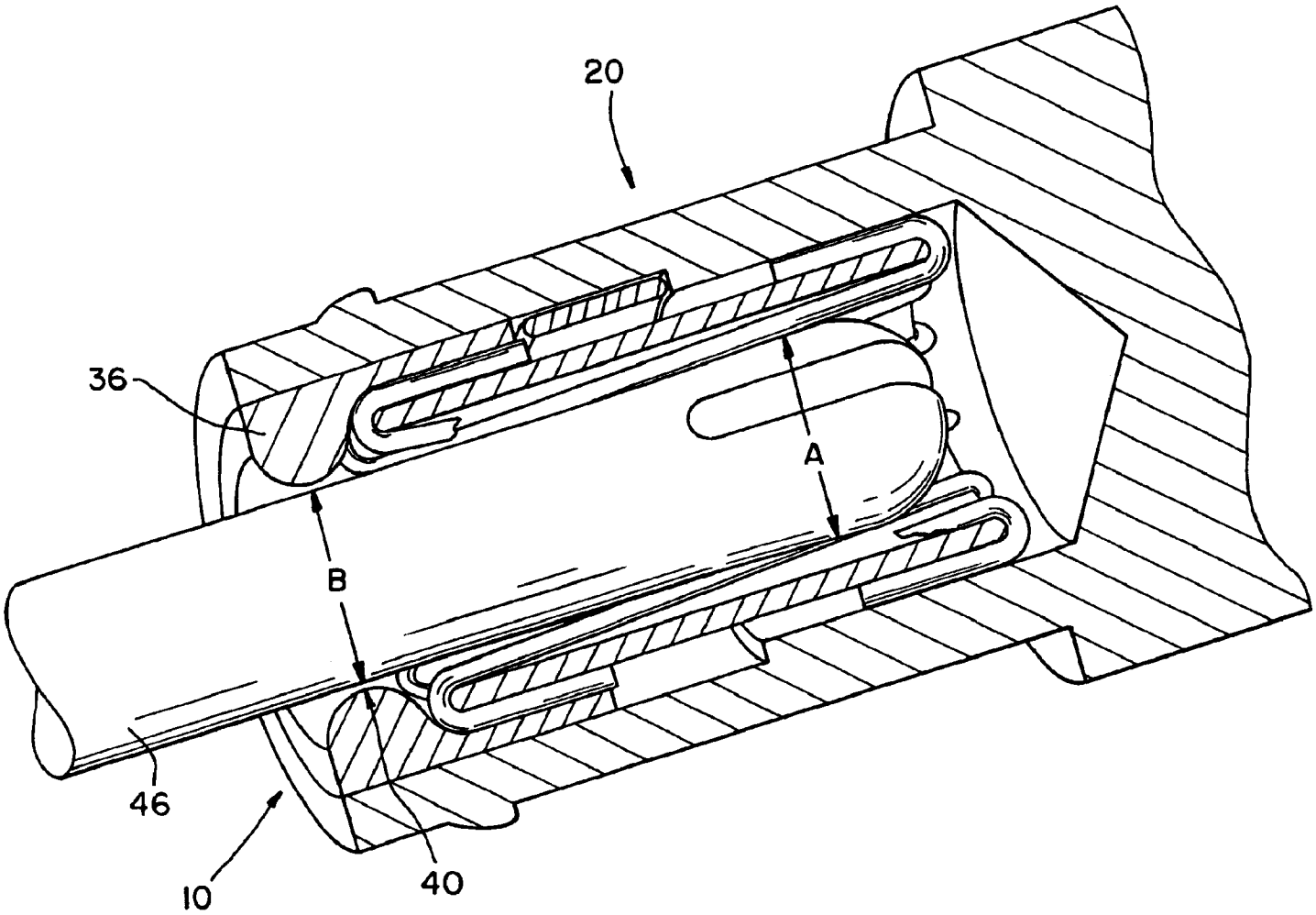
FIG. 2 is a enlarged partial section of view of the pin contact of FIG. 1 fully inserted into the socket contact.
Figure 3A:
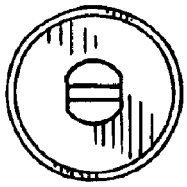
FIG. 3*a* is a front elevational view of one embodiment of the pin contact to the present invention.
Figure 3B:
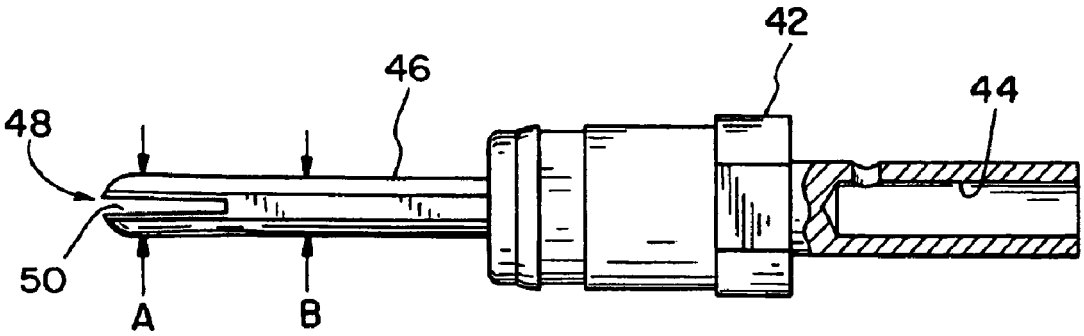
FIG. 3*b* is a side partial sectional view of the pin contact of FIG. 3*a;*
Figure 3C:
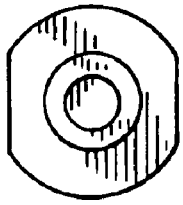
FIG. 3*c* is a back elevational view of the pin contact of FIG. 3*a*.

A preferred embodiment of the electrical connector as shown in FIGS. 1–4. In the illustrated embodiment, a female electrical conductor engages with a corresponding male connector as shown in FIG. 1 to form an electrical coupling. The electrical coupling 10, in generally comprised of two main components a female electrical connector 20 and a corresponding male electrical connector 22. When the female connector and male connector are axially mated together, electrical signals from two coaxial cables may be transmitted there between. In the Figs., the two coaxial cables are not shown. The electrical signals are transmitted by means of the inner and outer contact structure of the female electrical connector 20 coming into contact with the contact structure of the corresponding male electrical connector 22 when the male and female connectors are coaxially engaged.

Figure 4:
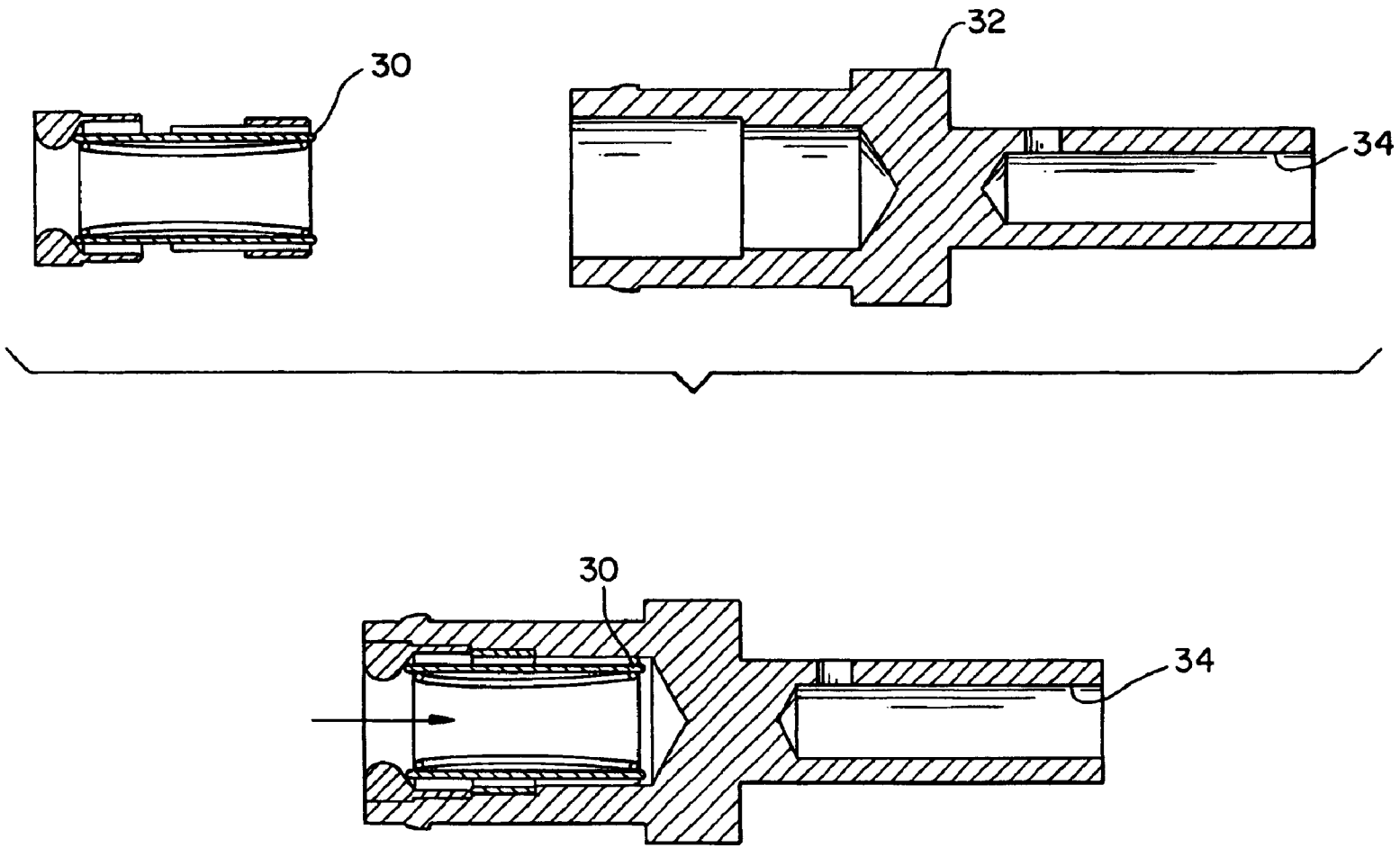
FIG. 4 is a sectional view of the socket body of FIG. 2 shown before and after assembly.

Female electrical connector is constructed by a formation of resilient conducting wires formed in a generally hyperboid shape 30 as known in the art and from U.S. Pat. No. 6,102,746 the disclosure of which is explicitly hereby incorporated by reference. The formation of contact wires 30 are pressed fit into the housing 32 as shown in FIG. 4. The housing 32 also includes a location for connection to the contact lead, not shown, such connection location 34 into which the connecting leads may be fixed. Electrical connection between the connection location 34 and the interfit wire formation 30 is not shown, but transfers through the interior of housing 32.

Referring to FIGS. 1 and 3*a–c* is a male electrical connector 22 of the present invention having a connection location 44 within a housing 42. The connection location 44 permits an insertion of a connector lead, not shown, to thereby be in electrical communication with pin element 46.

Around the outer periphery of the hyperbolic connection 30 is located a solid arc-suppressing ring or portion 36 that is an electrical communication with a formation of hyperbolic contact wires 30.

The present invention relates to a particular geometry of the arc suppressing ring or portion 36 compared to the geometry of pin element 46. Arc arresting ring or portion 36 has an opening 38 having a non-expanding inner surface 40. Arc suppressing ring 36 is formed of a solid metal or electrically conductive material.

The present invention includes the provision on pin element 46 of a collapsing structure 48 that is larger in diameter than opening 38, such that during insertion, electrical contact is first made between pin 46 and female electrical connector 20 at the arc suppressing ring 36. After such contact has been created and any electrical potential existing between the pin contact and socket are eliminated, the pin 46 enters into formation of wires 30 and is seated therein. After the pin element 46 is fully seated within formation 30, no further electrical contact is made between arc arresting ring 36 and pin member 46. In other words, all communicating of electrical potential passes through pin 46 through the formation of hyperbolic wire 30. This structure allows hot plugging of the assembly while a high electrical potential exists between the pin 46 and female electrical connector 20. This high electrical potential can result in arcing between the pin and socket contact as they are brought into close proximity.

In operation, as pin 46 is moved into or near contact with the socket contact, the initial arc is absorbed by the arc suppressing ring 36. In this fashion, electrical arcing between the pin 46 and thin wires of 30 are prevented. In more detail, the geometry of pin 46 is such that at in its distal end, a slot 50 is formed thereby forming a collapsible structure 48 that allows passage of pin 46 past opening 38. Other collapsible or shape changing structures may be equivalently utilized. In the most preferred embodiment of the invention, the outside diameter of pin 46 at location B is greater than the of interior diameter of opening 38, surface 40.

The diameter of the pin 46 at other locations besides 48 is smaller than the inside diameter of 38.

After penetration of the collapsing structure and slot structure 48 and 50 into wire formation 30, the geometry of pin 46 has a small diameter labeled as B. The limitations of diameter B of such that it is smaller than the diameter or opening of opening 38 of surface 40 thereby preventing electrical connection at that point. The creation of the collapsing structure 48 and or slot 50 creates a spring loaded spark arresting area on pin 46. Furthermore, the clearance between pin 46 and opening 38 (the difference in diameters between pin diameter B and surface 40) results in that the electrical contact is solely made within the receptacle basket or wire formation 30, eliminating the potential for fretting corrosion in vibrating environments at the arc-arresting portion. No high normal forces to the surface of pin 46 are experienced by or created by the arc suppressing ring 36 because of the clearance formed therebetween. The prevention of such high normal forces as found in the art is advantageous under high vibrations conditions.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An arc-arresting electrical connector, comprising:

a female connector member having a receiving opening and a receiving chamber, said receiving opening having an opening inner diameter, said receiving chamber having a chamber inner diameter;

an arc-arresting member mounted in said receiving opening of said female connector member, said arc-arresting member having an arc-arresting member inner diameter, said arc-arresting member inner diameter being less than each of said opening inner diameter and said chamber inner diameter; and a male connector member inserted in said female connector member through said arc-arresting member and into said receiving chamber, said male connector having a primary male portion and a distal end portion, said primary male portion having a primary male diameter, said distal end portion having a nominal distal end diameter, said nominal distal end diameter being greater than each of said primary male diameter and said arc-arresting member inner diameter, said distal end portion being a springably collapsible structure, said distal end portion thereby being configured for facilitating insertion thereof through said arc-arresting member inner diameter in a manner suppressing arc formation.

2. The arc-arresting electrical connector of claim 1, wherein said arc-arresting member is a solid ring member formed of an electrically conducting material.

3. The arc-arresting electrical connector of claim 1, wherein said male connector member is configured such that only said distal end portion thereof is to contact said arc-arresting ring during insertion of said male connector member through said arc-arresting ring and into said receiving chamber of said female connector member.

4. The arc-arresting electrical connector of claim 1, wherein said male connector member is in the form of an electrically conductive pin.

5. The arc-arresting electrical connector of claim 4, wherein said distal end portion of said pin is springably collapsible due at least in part to at least one slot formed therewithin.

6. The arc-arresting electrical connector of claim 1, wherein said female connector member carries a wire formation therein.

7. The arc-arresting electrical connector of claim 6, wherein said primary male diameter is less than said arc-arresting member inner diameter, said male connector being configured for forming an electrical connection solely with said wire formation upon full insertion of said male connector into said receiving chamber of said female connector member.

8. The arc-arresting electrical connector of claim 6, wherein said wire formation is a hyperbolic wire basket formation.

9. An arc-suppressing electrical connector, comprising:

a female connector having a female opening and a female chamber, said female chamber carrying a hyperbolic wire formation therein;

an arc suppressant carried by said female connector at said female opening, said arc suppressant having an arc suppressant opening and a corresponding an arc suppressant inner diameter; and a male connector inserted through said arc suppressant and into said female chamber, said male connector being brought into electrical contact with said hyperbolic wire formation, said male connector including a main body and a distal end, said distal end having a nominal distal diameter, said main body having a main diameter, said nominal distal diameter being greater than said main diameter and greater than said arc suppressant inner diameter, said distal end being springably collapsible and thereby insertable through said arc suppressant opening, said male connector being configured such that only said distal end thereof contacts said arc suppressant during insertion of said male connector into said female connector.

* * * * *